US006125510A

United States Patent [19]

Domenig

[11] Patent Number: 6,125,510

[45] Date of Patent: Oct. 3, 2000

[54] FURNITURE HINGE MOUNTING PLATE

[75] Inventor: Georg Domenig, Kernersville, N.C.

[73] Assignee: Grass America, Inc., Kernersville, N.C.

[21] Appl. No.: 09/316,583

[22] Filed: May 21, 1999

Related U.S. Application Data

[63] Continuation-in-part of application No. 09/271,694, Mar. 18, 1999.

[51] Int. Cl.[7] ..... E05D 5/00

[52] U.S. Cl. ..... 16/382; 16/236; 16/252

[58] Field of Search ..... 16/235, 236, 237, 16/252, 382, 239, 240

[56] References Cited

U.S. PATENT DOCUMENTS

| | | | |
|---|---|---|---|
| Re. 34,995 | 7/1995 | Domenig | 16/237 |
| 259,318 | 6/1882 | Kirk | 16/252 |
| 4,290,167 | 9/1981 | Lautenschlager | 16/129 |
| 4,554,706 | 11/1985 | Rock et al. | 16/237 |
| 5,067,200 | 11/1991 | Stowell et al. | 16/237 |
| 5,327,616 | 7/1994 | Lautenschlager | 16/382 |
| 5,355,559 | 10/1994 | Bowers et al. | 16/389 |
| 5,375,297 | 12/1994 | Lautenschlager et al. | 16/249 |
| 5,392,493 | 2/1995 | Youngdale | 16/237 |
| 5,412,841 | 5/1995 | Lautenschlager et al. | 16/249 |
| 5,414,896 | 5/1995 | Domenig | 16/248 |
| 5,454,144 | 10/1995 | Rupprechter | 16/382 |
| 5,617,612 | 4/1997 | Ferrari et al. | 16/278 |

*Primary Examiner*—Chuck Y. Mah
*Attorney, Agent, or Firm*—Kilpatrick Stockton, LLP

[57] ABSTRACT

A mounting plate for a furniture hinge includes a hinge plate which is adapted to be pivotably connected to a hinge component, such as a hinge cup, at least one pair, and preferably two pairs of opposing legs, depending from the hinge plate, and a fastener opening formed in the hinge plate between the opposing legs. The opposing legs are spaced apart from one another and depend from the hinge plate parallel to one another. Further, the opposing legs extend from the hinge plate a distance which is at least as great as or equal to the distance by which the opposing legs are spaced from one another.

19 Claims, 4 Drawing Sheets

FURNITURE HINGE MOUNTING PLATE

CROSS REFERENCE TO RELATED APPLICATIONS

This application is a continuation-in-part application of U.S. patent application Ser. No. 09/271,694 filed Mar. 18, 1999.

FIELD OF THE INVENTION

The present invention relates generally to furniture hinges, and more particularly, to a mounting plate for mounting a hinge on a furniture article, such as a desk of cabinet, which in turn supports a door on the furniture article.

BACKGROUND OF THE INVENTION

In the cabinetry industry, a typical construction feature, for example, in cabinets which are provided with doors, is a face frame on which the door is supported and hinged. The face frame members are affixed, for example, to an opening in the cabinet, and a pair of concealed hinges are affixed to an edge one of the face frame members and the door. Typically, the face frame member to which the hinges are affixed is made of a relatively strong material, such as hardwood, and has a thickness in the range, for example of about one-half inch to about five-eighths inch to about three fourths inch.

A customary mounting method of affixing the concealed hinge to the face frame member utilizes a hinge mounting plate which is positioned on an edge of the face frame member and fastened to the face frame member with one or more fasteners, such as fastening screws, inserted through one or more openings in the mounting plate and into, for example, one or more corresponding pre-drilled holes in the face frame member. Alternatively, the face frame may be omitted entirely, for example, in frameless cabinets, and the hinge plate may be affixed directly to an edge of a cabinet wall member in a substantially similar way.

The customary method of affixing concealed hinges works well, for example, on cabinet components made of relatively strong materials, such as hardwood. However, serious problems are encountered when attempts are made to employ the customary method of affixing concealed hinges, for example, to less expensive materials, which are not as strong as hardwood, such as medium density fiberboard (MDF). For example, attempts to employ the customary method of affixing concealed hinges in cabinetry by the manufactured home or mobile home industry, where MDF is typically used, have been unsuccessful.

Reasons for the lack of success in the manufactured home or mobile home industry are, for example, that when fasteners, such as fastening screws, are used in an edge of an MDF cabinet component, such as a face frame member, which ranges in thickness from about one-half inch to about five-eighths inch to about three-fourths inch (but which is most typically about one-half inch), the fastener tends to cause the cabinet component to split, and the fastener tends to pull out of the cabinet component under the weight of the door supported by the hinge. Accordingly, other types of hinges, such as surface mounted hinges, are typically used for such purposes, rather than more esthetically pleasing edge mounted concealed hinges.

SUMMARY OF THE INVENTION

It is a feature and advantage of the present invention to provide a furniture hinge for a mounting plate which is inexpensive to make, easy to use, and which enables use, for example, of concealed, edge-mounted type hinges on relatively weak and/or relatively thin cabinet components.

To achieve the stated and other features, advantages and objects of the present invention, an embodiment of the present invention provides a mounting plate for a furniture hinge which includes a hinge plate with opposing edges and opposing ends, and which is adapted to be pivotably connected to a hinge component, such as a hinge cup, at least one pair of opposing legs depending from the opposing edges of the hinge plate, and a fastener opening formed in the hinge plate between the opposing legs. The opposing legs depend from the hinge plate parallel to one another, are spaced apart from one another by a predetermined distance, and at least one of the opposing legs extends from the hinge plate a distance which is at least as great as the predetermined distance by which the opposing legs are spaced from one another, or the opposing legs can extend from the hinge plate a distance which is equal to the predetermined distance by which the opposing legs are spaced from one another.

In an embodiment of the present invention, in order to accommodate mounting on a cabinet component of a type used in manufactured or mobile homes made, for example, of relatively thin particle board, the opposing legs are spaced from one another by a distance of about one-half inch, more or less. Further, the fastener opening is centered on the hinge plate between the opposing legs. Each of the opposing legs has a distal end portion, and the distal end portions can be flared apart from one another to facilitate mounting on the furniture component. In order to accommodate vertical adjustment of a door supported by the hinge on a cabinet component, the fastener opening can be elongated. A hinge arm extends from one of the opposing edges of the mounting plate and is pivoted to the hinge component, such as the hinge cup, which is fastened, for example, in a recess formed in the door.

In an embodiment of the present invention, the hinge plate also has a second pair of opposing legs depending from the opposing edges of the hinge plate and a second fastener opening formed in the hinge plate between the second pair of opposing legs. The respective pairs of opposing legs are spaced apart from one another and depend from the opposing edges adjacent the opposing ends of the hinge plate. The opposing legs of each pair depend parallel to one another, and the opposing legs of each pair are spaced apart from one another by a predetermined distance, and at least one opposing leg of each pair extends from the hinge plate a distance which is at least as great as the predetermined distance.

In an embodiment of the present invention, in order to accommodate mounting on a cabinet component of the type used in manufactured or mobile homes, the opposing legs of each pair are spaced from one another a distance of about one-half inch, more or less. Further, each of the fastener openings is centered on the hinge plate between the opposing legs of each pair of opposing legs. Each of the opposing legs has a distal end portion which can be flared apart from one another to accommodate mounting on a furniture component. Each fastener opening is elongated to allow vertical adjustment of the door relative to the furniture component, and a hinge arm extends from one of the opposing edges of the mounting plate and is pivoted to the hinge cup.

The mounting plate for another embodiment of the present invention includes a hinge plate with opposing edges and opposing ends and adapted to be pivotably connected to a hinge component, such as a hinge cup. At least one flange depends from one of the opposing edges of the hinge plate and has an upper edge and a lower edge and at least one fastener opening formed in the flange. The flange depends at an angle of substantially 95 degrees relative to the hinge plate. One or two opposing, spaced apart tabs depend from the other opposing edge of the hinge plate at an angle of substantially 90 degrees relative to the hinge plate, each of which tabs depends a distance which is substantially less than the distance by which the flange depends from the hinge plate. Also, a hinge arm extends from the other of the opposing edges of the hinge plate, and the hinge cup is pivoted to the hinge arm. The opposing edges of the hinge plate are spaced from one another by a distance which determines a width of the hinge plate, and the flange depends from the hinge plate by a distance which is one of at least as great as the width of the hinge plate, equal to the width of the hinge plate, or greater than the width of the hinge plate. In any of such cases, the width of the hinge plate can vary from substantially one-half inch, to substantially five-eighths inch, to substantially three-fourths inch. The opposing tabs depend from the hinge plate a distance which is substantially less than the distance from which the flange depends from the hinge plate. At the end distal from the hinge plate, a short portion of the flange may curve inwardly toward the opposing tabs.

Additionally, in such embodiment, the flange has portions defining at least one fastener opening, which is disposed proximate or near the lower edge of the flange, for example, nearer to the lower edge of the flange than the upper edge of the flange. The fastener openings are elongate and can be closed, can include projections in the opening for supporting a pre-mounted fastening screw, or can be open to the lower edge of the flange. The hinge plate may also have one or more fastener openings.

Additional objects, advantages and novel features of the present invention will be set forth in part in the description which follows, and in part with become more apparent to those skilled in the art upon examination of the following or may be learned by practice of the invention.

DETAILED DESCRIPTION

Figure 1:
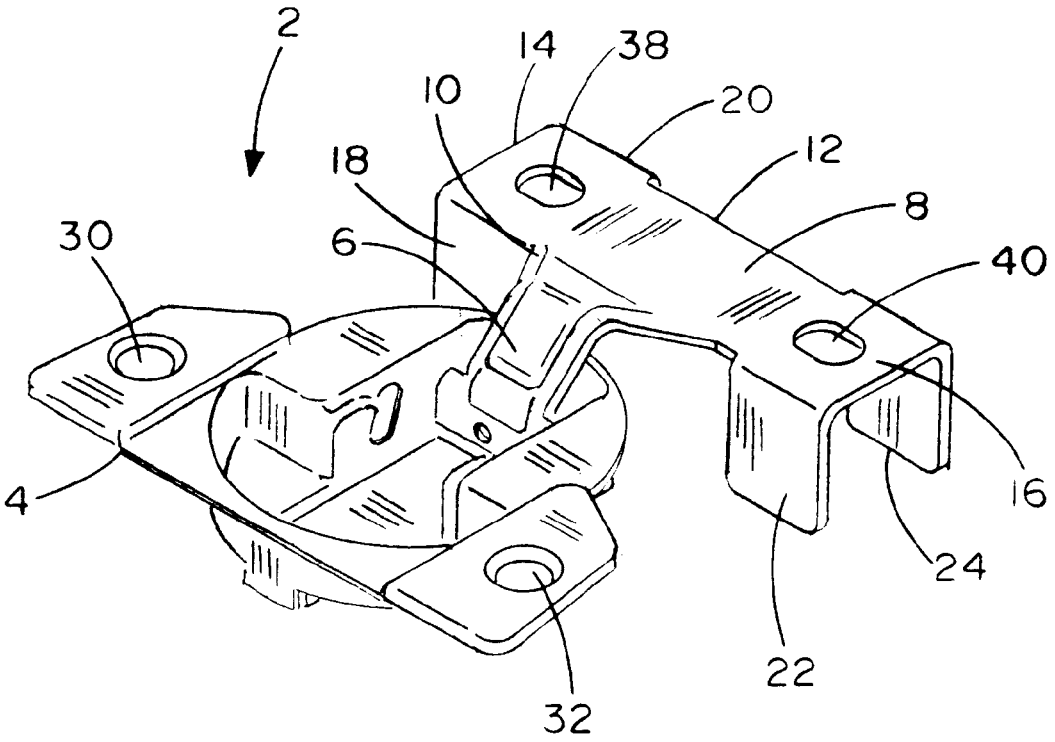
FIG. 1 shows a perspective view of a hinge for an embodiment of the present invention.

Referring now in detail to an embodiment of the present invention, an example, of which is illustrated in the accompanying drawings, FIG. 1 shows a perspective view of the hinge 2 for an embodiment of the present invention. The hinge 2 includes a hinge cup 4 which is mountable, for example, in a recess of a cabinet door and a hinge arm 6, which is pivotably connected to the hinge cup 4. The hinge arm 6 extends from a hinge plate 8, which is mountable on a cabinet component, such as a face frame member. The hinge plate 8 is generally rectangular in shape with opposing edges 10 and 12 and opposing ends 14 and 16. A first pair of opposing legs 18 and 20 depend from opposing edges 10 and 12 at or near one of the opposing ends 14, and a second pair of opposing legs 22 and 24 extend from the opposing edges 10 and 12 at or near the other of the opposing ends 16.

In an embodiment of the present invention, opposing legs 18 and 20, together with the portion of hinge plate 8 disposed between legs 18 and 20, define a generally C-shaped cross section. Likewise, opposing legs 22 and 24, together with the portion of hinge plate 8 disposed between opposing legs 22 and 24, define a generally C-shaped cross section. Alternatively, a single pair of opposing legs can extend from opposing edges 10 and 12 for the entire length of the hinge plate 8, likewise defining a generally C-shaped cross section. However, such an alternative requires additional engineering and manufacturing techniques, utilizes more manufacturing material, such as steel, and increases design and manufacturing costs.

Figure 2:
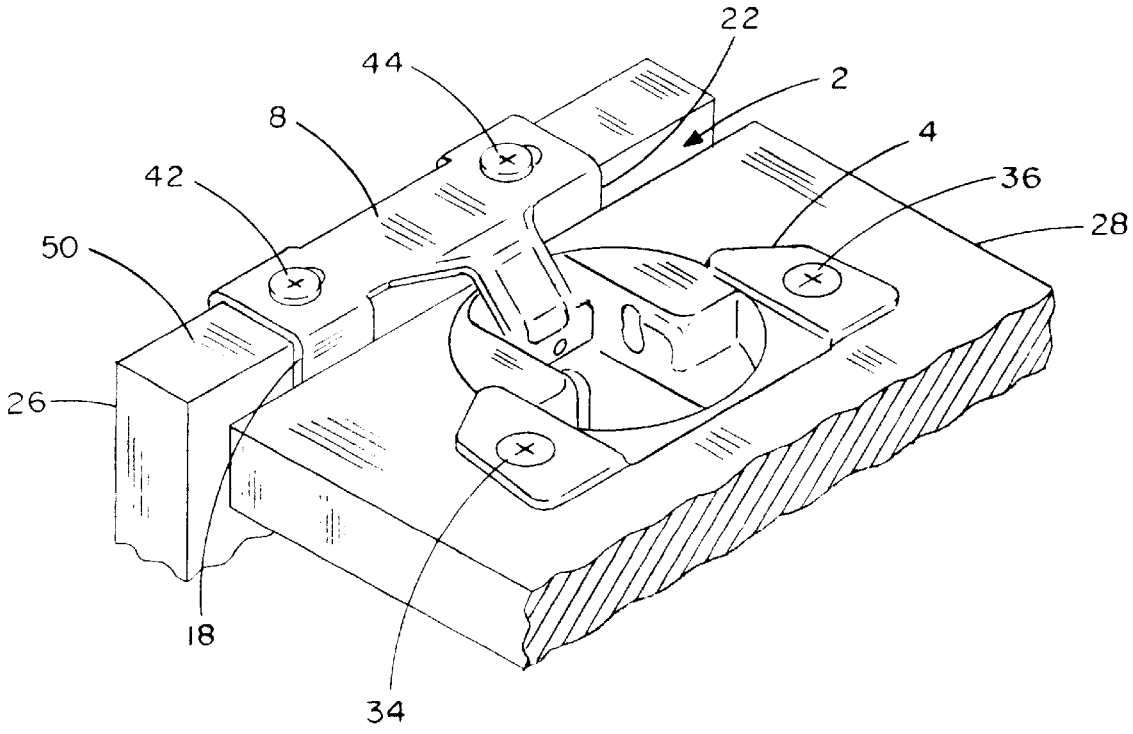
FIG. 2 shows a perspective view of the hinge of FIG. 1 mounted on a cabinet component, such as a face frame member, and a cabinet door for an embodiment of the present invention.
Figure 3:
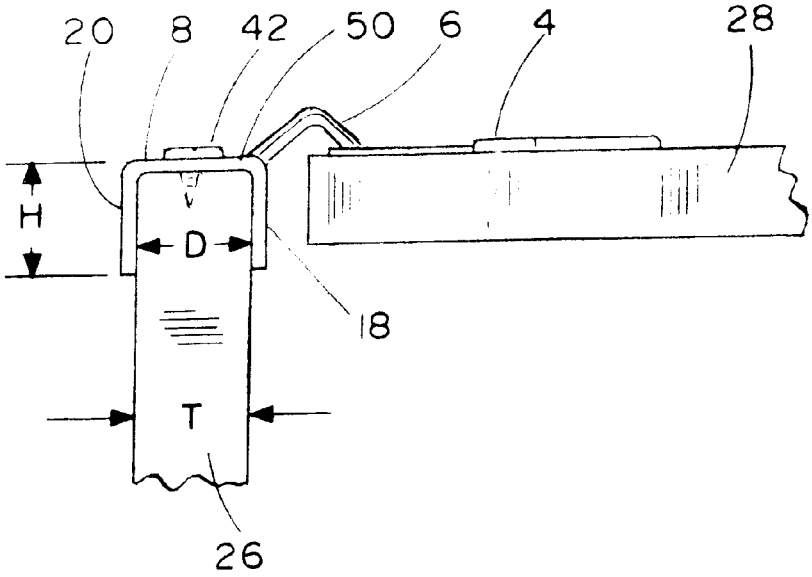
FIG. 3 is a side view of a hinge plate of the hinge mounted on the face frame member, as shown in FIG. 2, for an embodiment of the present invention.

FIG. 2 shows a perspective view of the hinge 2 of FIG. 1 mounted on a cabinet component, such as a face frame member 26 and a cabinet door 28 for an embodiment of the present invention. FIG. 3 is a side view of the hinge plate 8 of hinge 2 mounted on the face frame member 26 as shown in FIG. 2 for an embodiment of the present invention. As shown in FIG. 1, the hinge cup 4 is provided with openings 30 and 32 for receiving fasteners, such as fastening screws 34 and 36, for affixing the hinge cup to cabinet door 28. The hinge plate 8 is also provided with openings 38 and 40 for receiving fasteners, such as fastening screws 42 and 44, for affixing the hinge plate to the cabinet component, such as face frame member 26.

In an embodiment of the present invention, a manner or mode of using hinge 2 includes, for example, first affixing a pair of the hinges to cabinet door 28 with fastening screws 34 and 36 and then positioning the hinge plate 8 against an edge portion 50 of cabinet component 26 with opposing legs 18 and 20 against opposite surfaces of cabinet component 26 adjacent the edge portion of the cabinet component, and with opposing legs 22 and 24 likewise against opposite surfaces of cabinet component 26 adjacent the edge portion of the cabinet component. With the hinge plate 8 so positioned, the fastening screws 42 and 44 can then be inserted in openings 38 and 40 and screwed into the edge portion 50 of the cabinet component 26.

In an embodiment of the present invention, opposing legs 18 and 20 are each perpendicular to hinge plate 8 and parallel to one another. Likewise, opposing legs 22 and 24 are each perpendicular to hinge plate 8 and parallel to one another. Further, in an embodiment of the present invention, opposing legs 18 and 20 are spaced apart from one another by a distance "D" that is at least as great as a thickness "T" of cabinet member 26, and opposing legs 22 and 24 are likewise spaced apart from one another by the distance "D" that is likewise at least as great as the thickness "T" of cabinet member 26. A reason for the parallel relationship and spacing of the respective pairs of opposing legs 18, 20 and 22, 24 is, for example, to facilitate mounting of the hinge plate 8 and its depending legs on the edge portion 50 of the cabinet component 26.

In an embodiment of the present invention, additionally, opposing legs 18 and 20 are spaced apart from one another by a distance "D" that is equal to a thickness "T" of cabinet member 26. A reason for such spacing is that when fastening screws 42 and 44 are inserted in openings 38 and 40 and screwed into the edge portion 50 of cabinet member 26, opposing legs 18, 20 and 22, 24 resting against the opposite surfaces of cabinet component 26 adjacent the edge portion, in confronting relationship with the opposite surfaces, provide support against splitting of the edge portion as fastening screws 42 and 44 are driven into the edge portion. Further, in order to accommodate a cabinet component, such as face frame member 26, which is relatively thin, in the range of about one-half inch to about five-eighths inch, the distance "D" between opposing legs 18 and 20 and between opposing legs 22 and 24 is not more than about one-half inch and is preferably about one-half inch or slightly less.

In an embodiment of the present invention, to provide additional support against such splitting of the edge portion of cabinet component 25, the pairs of opposing legs 18, 20 and 22, 24 depend a relatively long distance "H" from hinge plate 8. For example, the pairs of opposing legs 18, 20 and 22, 24 extend the distance "H'" from hinge plate 8 that is about equal to the distance "D" that opposing legs 18 and 20 and opposing legs 22 and 24 are spaced from one another, or preferably a distance "H" of about one-half inch, although the distance can vary from about seven-sixteenths inch to about five-eighths inch. In other words, legs 18 and 22 can each extend a distance ranging from about seven-sixteenths inch up to about five-eighths inch, and legs 20 and 24 can each likewise extend a distance ranging from about seven-sixteenths inch up to about five-eighths inch.

Figure 4:
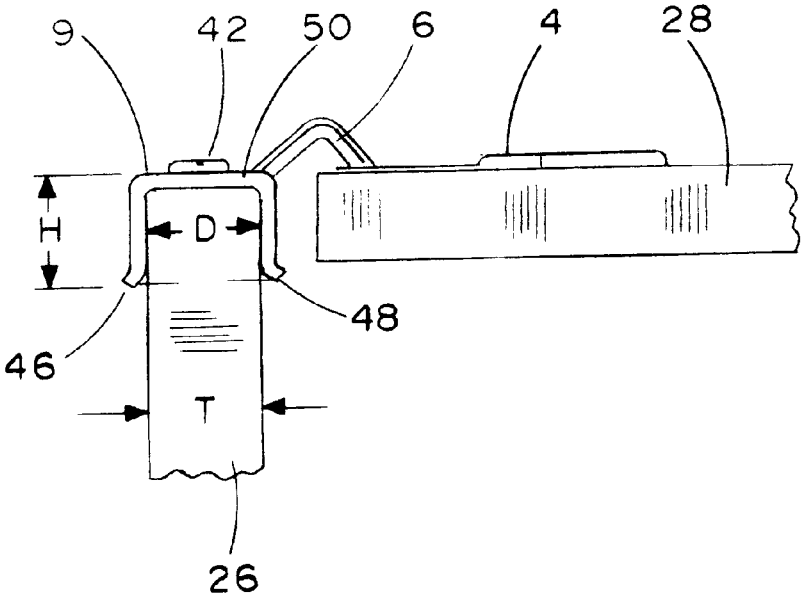
FIG. 4 is a side view of a hinge plate of an alternate embodiment of the hinge mounted on the face frame member for an embodiment of the present invention.

In an embodiment of the present invention, while it is an important feature of the present invention that the opposing legs 18, 20 and 22, 24, respectively are parallel to one another, in order to further accommodate the positioning of hinge plate 8 against the edge portion 50 of cabinet component 26, the distal ends 46 and 48 of opposing legs 18 and 20, and the corresponding distal ends of opposing legs 22 and 24 can be flared slightly apart from one another. FIG. 4 is a side view of a hinge plate 9 of an alternate embodiment of the hinge 2 mounted on the face frame member 26. Thus the distal ends 46 and 48 of opposing legs 18 and 20 and the corresponding distal ends of opposing legs 22 and 24 can be spaced apart from one another by a distance "D'" which is slightly greater than the distance "D" by which the respective parallel portions of opposing legs 18 and 20 and opposing legs 22 and 24 are spaced apart from one another.

In an embodiment of the present invention, as the opposing legs 18 and 20 and the opposing legs 22 and 24 furnish support against splitting of edge portion 50 when fastening screws 42 and 44 are driven into the edge portion of the cabinet component 26, it is advantageous to position fastening screw opening 38 in hinge plate 8 substantially between opposing flanges 18 and 20 and to likewise position fastening screw opening 40 in hinge plate 8 substantially between opposing flanges 22 and 24. Further, for a like reason, it is advantageous that fastening screw openings 38 and 40 be substantially centered between opposing edges 10 and 12 of hinge plate 8.

In an embodiment of the present invention, while a single fastening screw opening can be utilized, it would require, for example, a somewhat larger fastening screw which would substantially increase the splitting problem. Thus, it is advantageous to use two fastening screws 42 and 44 instead of a single fastening screw. In order to accommodate a moderate degree of adjustment of the door 28 after it is mounted to the cabinet component 26 on hinge 2, the fastening screw openings 38 and 40 in the hinge plate 8 are slightly elongated. Thus, after driving screws 42 and 44 into the edge portion of cabinet component 26, the position of door 28 can be adjusted in a vertical direction relative to cabinet component 26 by loosening fastening screws 42 and 44.

Figure 5:
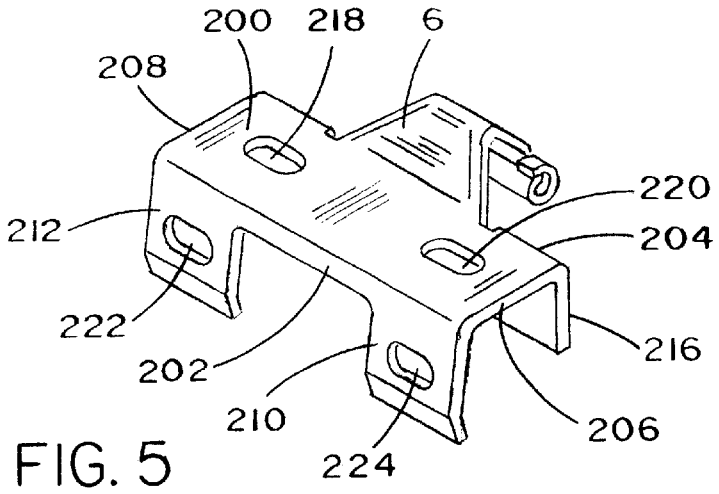
FIG. 5 shows a rear perspective view of a hinge plate for an embodiment of the present invention.
Figure 6:
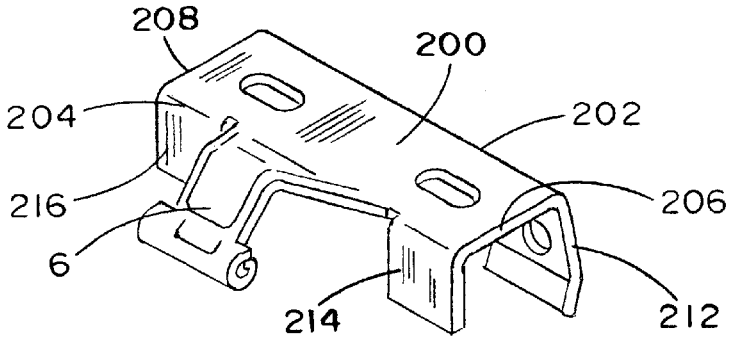
FIG. 6 shows a front perspective view of the hinge plate of FIG. 5.
Figure 7:
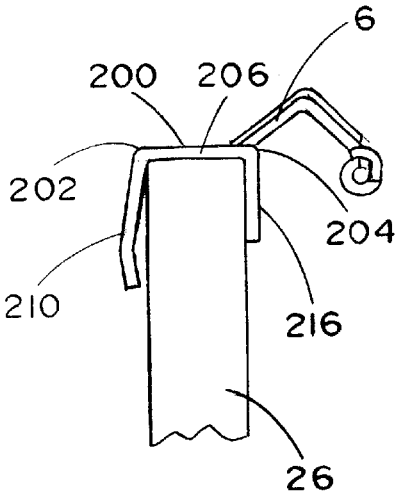
FIG. 7 is a side view of a hinge plate mounted on the face frame member, as shown in FIG. 5, mounted on a cabinet component, such as a face frame member, for an embodiment of the present invention.
Figure 8:
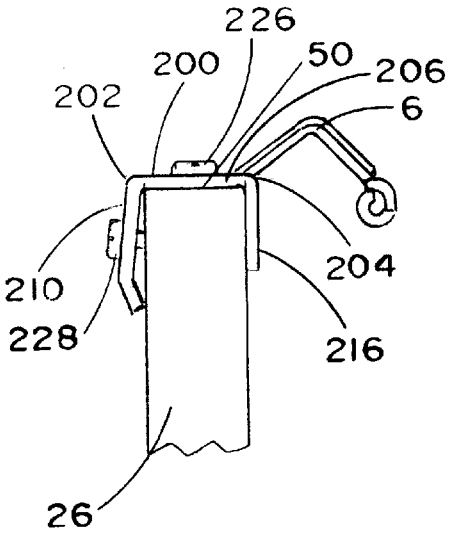
FIG. 8 is a side view of a hinge plate mounted on the face frame member, as shown in FIG. 7, showing fasteners securing the hinge plate to the face frame member.

FIG. 5 shows a rear perspective view of a mounting plate for another embodiment of the present invention; FIG. 6 shows a front perspective view of the mounting plate of FIG. 5; and FIGS. 7 and 8 show side views of the hinge plate of FIG. 5 mounted on the face frame member 26. Referring to FIGS. 5, 6, 7, and 8, hinge arm 6 extends from hinge plate 200 which is mountable on face frame member 26. Hinge plate 200 has opposing edges 202 and 204 and opposing ends 206 and 208. Fastener openings 218 and 220 are formed in the hinge plate 200. First and second flanges 210 and 212 depend from rear edge 202 at or near ends 206 and 208, respectively, and are spaced apart from one another. First and second flanges 210 and 212 depend from rear edge 202 a distance greater than the width of hinge plate 200, defined by the distance between opposing edges 202 and 204. First and second opposing tabs 214 and 216 depend from front edge 204 at or near ends 206 and 208, respectively, and are likewise spaced apart from one another. Opposing tabs 216 and 214 do not extend as far from their attachment to the opposing edge 204 of hinge plate 200 as flanges 210 and 212 extend from opposing edge 202 of hinge plate 200.

Each flange 212 or 210 has portions defining at least one fastener opening 222 or 224, respectively, which is disposed proximate or near the lower edge of the flange, for example, nearer to the lower edge of the flange than the upper edge of the flange. The fastener openings are elongate and can be closed, can include projections in the opening for supporting a pre-mounted fastening screw, or can be open to the lower edge of the flange. The hinge plate 200 may also have one or more fastener openings 218 and 220, as shown in FIGS. 5 and 6.

FIG. 7 shows the hinge plate mounted on the face member 26 prior to insertion and tightening of a fastener such as screw 228 inserted in hole 224 of the flange 210, as shown in FIG. 8. FIG. 8 also shows a fastener such as screw 226 inserted in fastener opening 220 of the hinge plate 200.

FIG. 7 shows that flanges 210 and 212 (212 not shown in this side view) are disposed at an angle of substantially 95° in relation to the hinge plate 200. This allows ease of initial mounting of the hinge plate on the face frame 26. In addition to FIGS. 5 and 6, FIG. 7 further illustrates that flanges 210 and 212 curve slightly inward toward opposing tabs 216 and 214, respectively. This feature provides that the attachment point between flanges 210 and 212 and opposing edge 202 of hinge plate 200 will not be stressed to breaking by tightening of a fastener such as screw 228, as shown in FIG. 8. FIG. 8 illustrates that the inwardly curved distal end of flanges 210 and 212 serves as a stop when a fastener through flange fastener openings 222 or 224 is tightened to secure the flange to the face frame member 26.

Various preferred embodiments of the present invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention. Accordingly, the invention is limited only by the following claims.

What is claimed is:

1. A mounting plate for a furniture hinge, comprising:

a hinge plate having opposing edges and opposing ends and adapted to be pivotably connected to a hinge component;

at least one flange having an upper edge and a lower edge and depending from one of the opposing edges of the hinge plate at an angle of substantially 95 degrees relative to the hinge plate;

at least one fastener opening formed in the flange; and at least one tab depending from the other of the opposing edges of the hinge plate.

2. The mounting plate of claim 1, further comprising a hinge arm extending from the other of the opposing edges of the hinge plate.

3. The mounting plate of claim 1, wherein the hinge component further comprises a hinge cup.

4. The mounting plate of claim 1, wherein the tab depends at an angle of substantially 90 degrees relative to the hinge plate.

5. The mounting plate of claim 1, wherein the at least one flange depends from the hinge plate a distance which is greater than the width of the hinge plate.

6. The mounting plate of claim 1, wherein the tab depends from the hinge plate a distance which is less than a distance by which the at least one flange depends from the hinge plate.

7. The mounting plate of claim 1, further comprising a second tab depending from the other of the opposing edges of the hinge plate.

8. The mounting plate of claim 7, wherein both tabs depend from the hinge plate a distance which is less than a distance by which the flange depends from the hinge plate.

9. The mounting plate of claim 1, wherein the fastener opening in the at least one flange is disposed proximate the lower edge of the flange.

10. The mounting plate of claim 9, wherein the fastener opening is disposed nearer to the lower edge of the flange than the upper edge of the flange.

11. The mounting plate of claim 1, wherein the hinge plate further comprises at least one fastener opening.

12. The mounting plate of claim 11, wherein the hinge plate further comprises a second fastener opening spaced from said at least one fastener opening.

13. The mounting plate of claim 1, wherein said at least one flange further comprises two, spaced apart flanges depending from the same opposing edge of the hinge plate.

14. The mounting plate of claim 1, wherein the distal end of the at least one flange curves inward in the direction of the opposing at least one tab.

15. The mounting plate of claim 1, wherein the opposing edges of the hinge plate are spaced from one another a distance which determines a width of the hinge plate, and the at least one flange depends from the hinge plate a distance which is at least as great as the width of the hinge plate.

16. The mounting plate of claim 15, wherein the width of the hinge plate is substantially one-half inch.

17. The mounting plate of claim 15, wherein the width of the hinge plate is substantially five-eighths inch.

18. The mounting plate of claim 15, wherein the width of the hinge plate is substantially three-fourths inch.

19. A mounting plate for a furniture hinge, comprising:

a hinge plate having opposing edges, opposing ends, and two spaced apart fastener openings, and adapted to be pivotably connected to a hinge component;

two spaced apart flanges having upper edges and lower edges and a fastener opening disposed proximate the lower edges, and depending from one of the opposing edges of the hinge plate a distance which is greater than the width of the hinge plate at an angle of substantially 95 degrees relative to the hinge plate; and two tabs depending from the other of the opposing edges of the hinge plate a distance less than the distance the flanges depend from the hinge plate, and at an angle of substantially 90 degrees relative to the hinge plate, wherein the lower edge of the flanges curves inward in the direction of the opposing tabs in a manner which provides a stop against the surface of a face frame member when fasteners are tightened to affix the mounting plate to the face frame member, thereby preventing damage to the hinge plate from excess stress at the junction of the flanges and the hinge plate.

* * * * *